US007128609B1

(12) United States Patent
Chen

(10) Patent No.: US 7,128,609 B1
(45) Date of Patent: Oct. 31, 2006

(54) MINI-UNIVERSAL SERIAL BUS CONNECTOR ASSEMBLY

(75) Inventor: Lu-Cheng Chen, Taipei (TW)

(73) Assignee: He-And Technology Co., Ltd., Taipei (TW)

( * ) Notice: Subject to any disclaimer, the term of this patent is extended or adjusted under 35 U.S.C. 154(b) by 0 days.

(21) Appl. No.: 11/312,752

(22) Filed: Dec. 21, 2005

(30) Foreign Application Priority Data

Jun. 7, 2005 (TW) ..... 94209478 U

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS 6,508,678 B1 * 1/2003 Yang ..... 439/677
6,659,799 B1 * 12/2003 Yang ..... 439/607
6,685,508 B1 * 2/2004 Zhu et al. ..... 439/607
6,722,919 B1 * 4/2004 Lin ..... 439/569
6,764,337 B1 * 7/2004 Nishio et al. ..... 439/607
6,840,806 B1 * 1/2005 Kodama ..... 439/607
6,902,432 B1 * 6/2005 Morikawa et al. ..... 439/607
2005/0186843 A1 * 8/2005 Tsai ..... 439/607
2005/0245132 A1 * 11/2005 Huang et al. ..... 439/607
2005/0277332 A1 * 12/2005 Chen ..... 439/607

* cited by examiner

*Primary Examiner*—Hae Moon Hyeon
(74) *Attorney, Agent, or Firm*—Rosenberg, Klein & Lee

(57) ABSTRACT

A mini-Universal Serial Bus (USB) connector assembly with more terminals is used to fasten the transfer speed. A mini-USB connector assembly includes a male USB connector and a female USB connector. The male USB connector includes an isolation body, a front metallic housing, a rear metallic housing and a plurality of terminals. Periphery of the main body is enclosed by the rear metallic housing. The terminals are manufactured by an insert molding process, and the terminals are positioned alongside on the bottom surface of the extension plates. The female USB connector includes a corresponding isolation body, a corresponding metallic housing and a plurality of corresponding terminals. The corresponding terminals are manufactured by an insert molding process, and the corresponding terminals are positioned alongside on the bottom surface of the corresponding extension plates. The male USB connector and the female USB connector respectively have 8 terminals.

10 Claims, 5 Drawing Sheets

MINI-UNIVERSAL SERIAL BUS CONNECTOR ASSEMBLY

BACKGROUND OF THE INVENTION

1. Field of the Invention

The present invention relates to a mini-USB connector assembly, and in particular to a mini connector assembly with a universal series bus interface that is suitable for portable electronic appliance and is plug-and-play.

2. Description of Related Art

Universal Serial Bus (USB) interfaces are introduced to computer-related appliances. The USB interface is configured to support plug-and-play device and is hot-swappable. That is, the USB interface has a capability to be plugged or unplugged without removing the power or rebooting the computer. One USB connector is allowed for up to 127 peripherals to be attached including speakers, telephone sets, CD-ROM drives, joysticks, magnetic tap devices, keyboards, scanners and digital cameras. The USB connection ports are usually positioned near parallel ports or serial ports.

Especially, mini-USB ports are implemented in portable electronic appliances so that the portable electronic appliances are plug-and-play. To be compatible with current specification, the mini-USB ports are only configured with four terminals so that the mini-USB ports do not deal with demand for more data and higher transfer speed.

Thus, there is a need for a new mini-USB connector assembly.

SUMMARY OF THE INVENTION

It is an object of the present invention to provide a mini-USB connector assembly with more terminals to fasten the transfer speed without enlarging its volume.

To achieve object of the present invention, a mini-USB connector assembly includes a male USB connector and a female USB connector. The male USB connector includes an isolation body, a front metallic housing, a rear metallic housing and a plurality of terminals. The isolation body includes a main body and a extension plate extending from the main body. The extension plate is enclosed by the front metallic, and a top surface of the extension plate abuts against a top plate of the front metallic housing. An insertion space is formed between a bottom surface of the extension plate and the front metallic housing. Periphery of the main body is enclosed by the rear metallic housing. The terminals are manufactured by an insert molding process, and the terminals are positioned alongside on the bottom surface of the extension plates and penetrate through the main body so that the terminals can be soldered to a circuit board. The female USB connector includes a corresponding isolation body, a corresponding metallic housing and a plurality of corresponding terminals. The corresponding isolation body includes a corresponding main body and a corresponding extension plate extending from the corresponding main body. A shape of the corresponding extension plate corresponds to the insertion space. The corresponding isolation body is enclosed by the corresponding metallic housing. In addition, the corresponding terminals are manufactured by an insert molding process, and the corresponding terminals are positioned alongside on the bottom surface of the corresponding extension plates and penetrate through the corresponding main body so that the terminals can be soldered to a circuit board.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
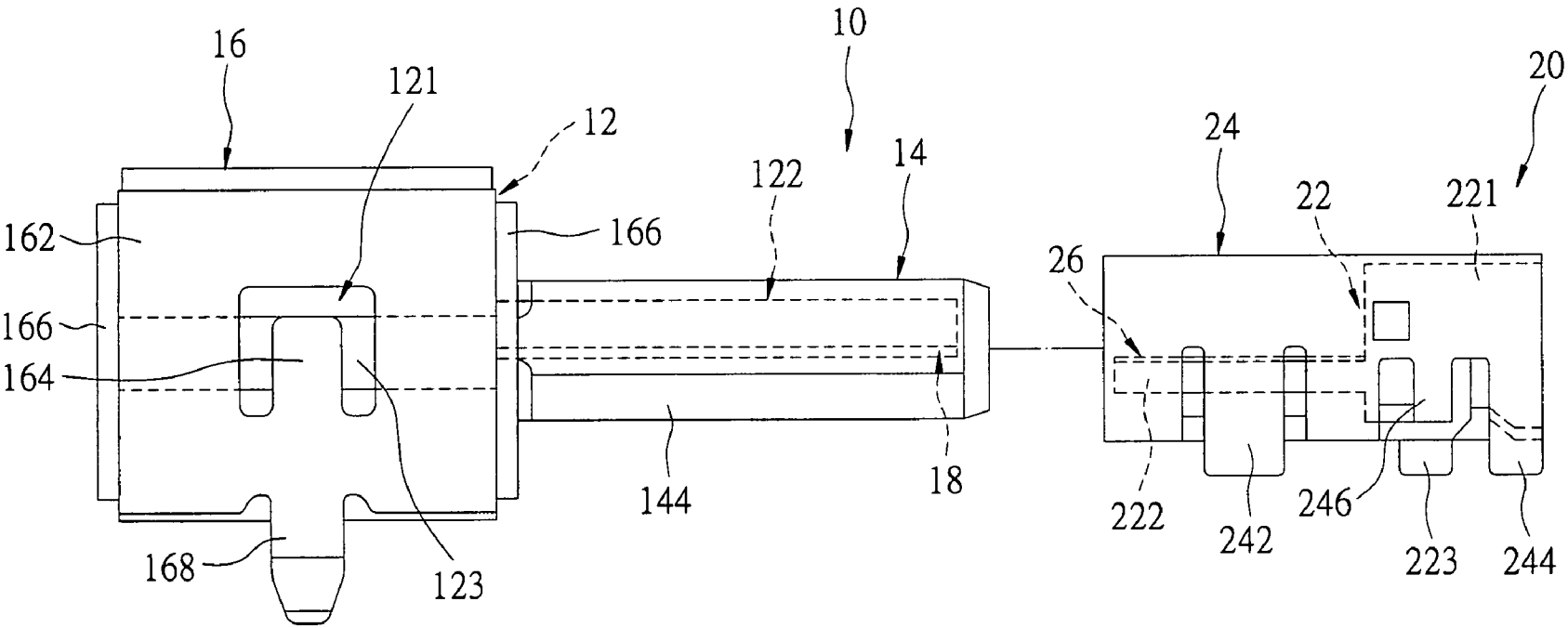
FIG. 1 is a side view of a mini-USB connector assembly according to the present invention.
Figure 2:
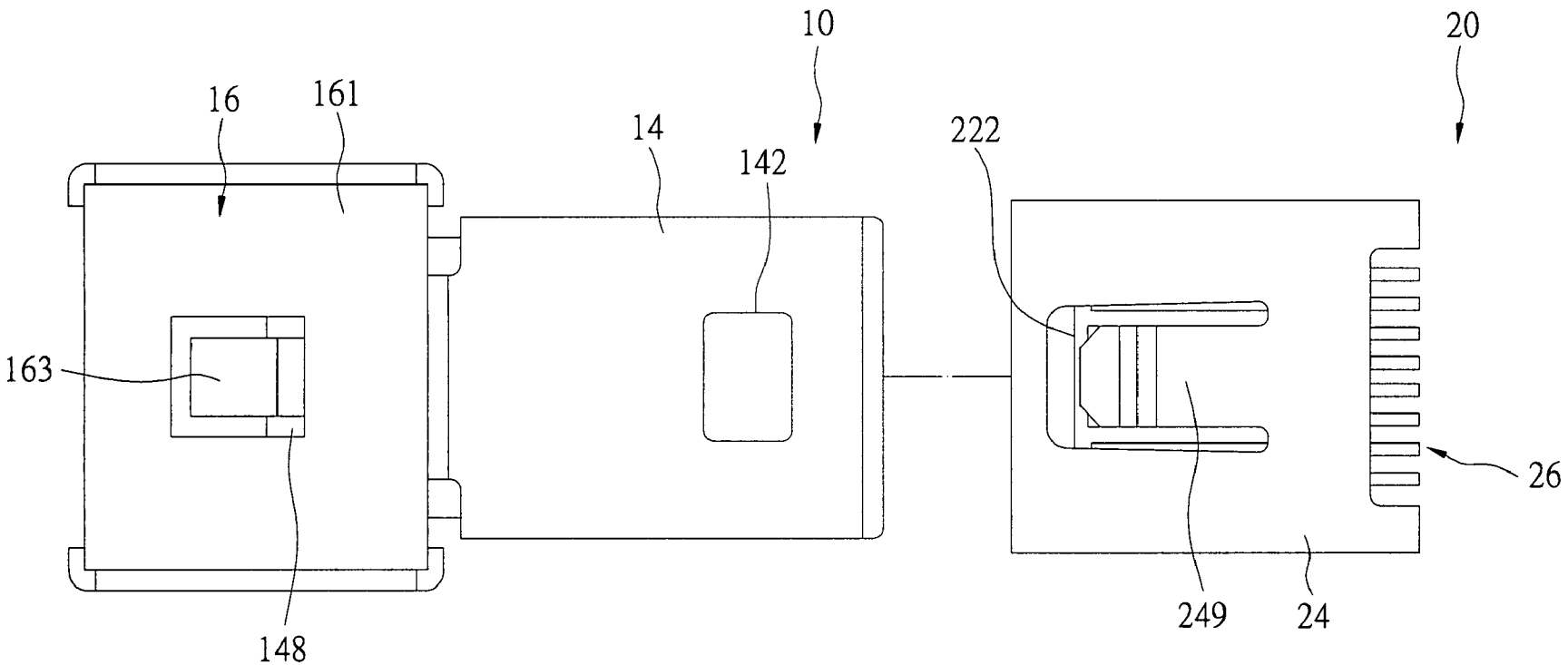
FIG. 2 is a top plan view of a mini-USB connector assembly according to the present invention.
Figure 3:
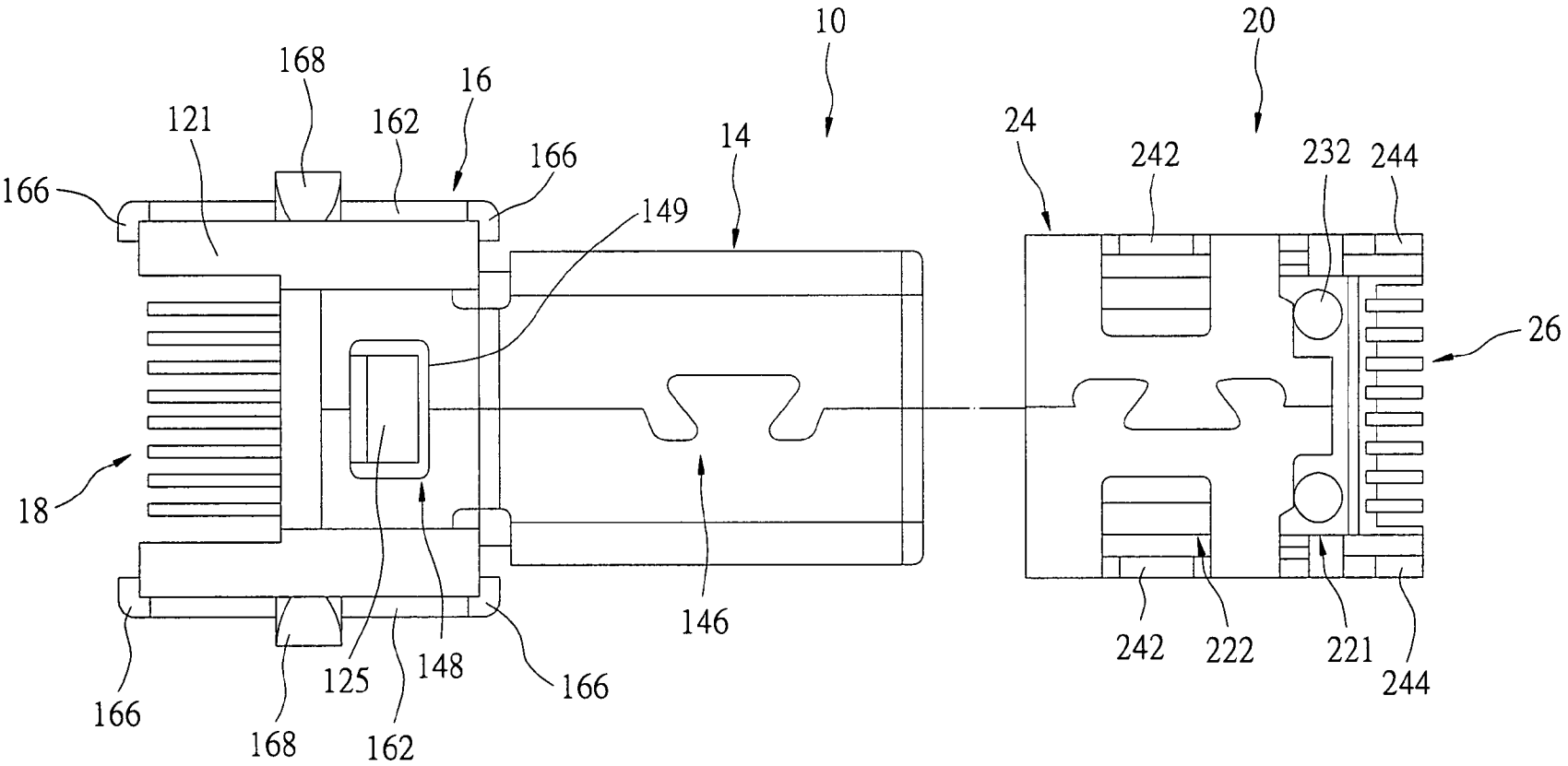
FIG. 3 is a bottom plan view of a mini-USB connector assembly according to the present invention.

Reference is made to FIGS. 1–3. FIGS. 1–3 respectively illustrates a side view, a top plan view and a bottom plan view of a mini-USB connector assembly according to the present invention. The present invention provides a mini-USB connector assembly including a male USB connector 10 and a female USB connector 20.

Figure 4:
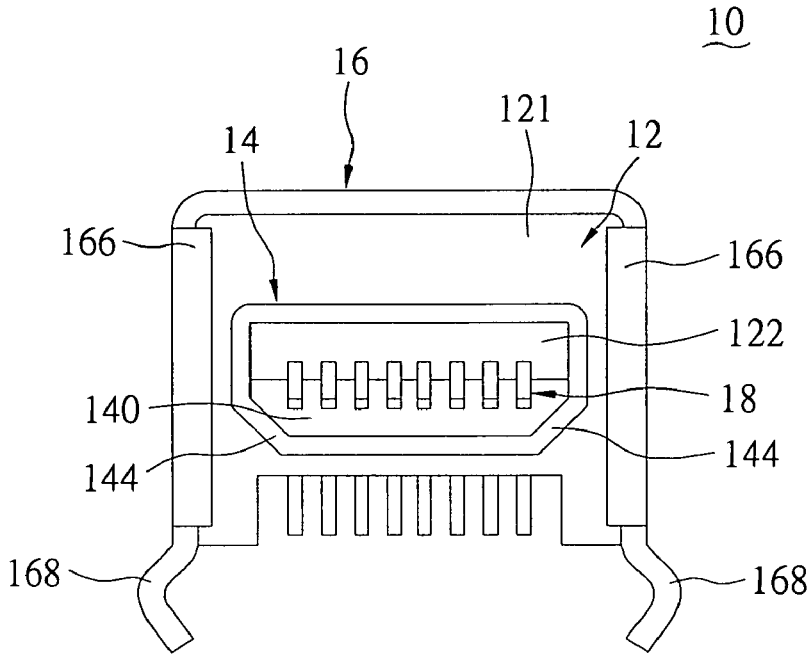
FIG. 4 is a front plan view of a male USB connector according to the present invention.
Figure 5:
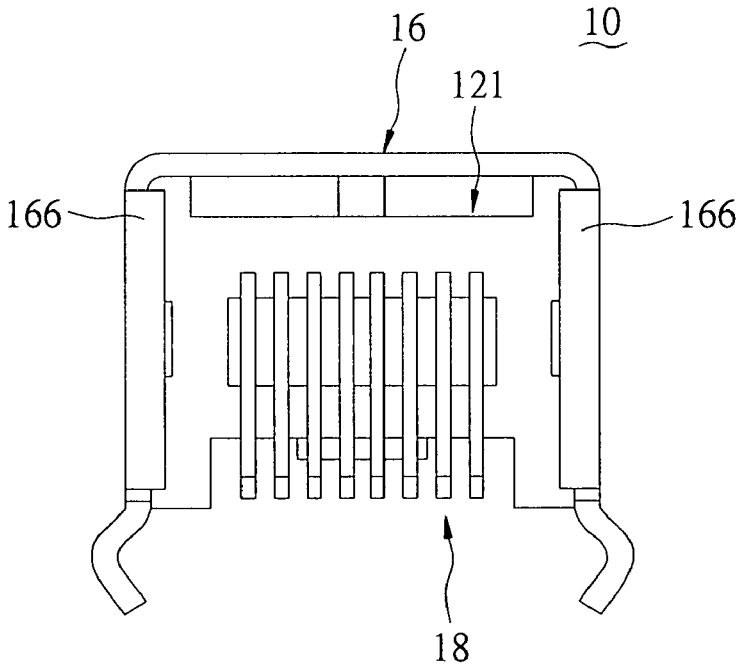
FIG. 5 is a rear plan view of a male USB connector according to the present invention.

To begin with, reference is made to FIGS. 4 and 5. FIGS. 4 and 5 illustrate a front plan view and a rear plan view of the male USB connector 10. The male USB connector 10 includes an isolation body 12, a front metallic housing 14, a rear metallic housing 16 and a plurality of terminals 18. According to the present invention, the male USB connector 10 and the female USB connector 20 respectively have 8 terminals so that transfer speed is enhanced. The present invention is not limited to 8 terminals.

The isolation body 12 is made of isolation material and includes a main body 121 and a extension plate 122 extending from the main body 121. The terminals 18 are positioned alongside at a bottom surface of the extension plate 122 so that the terminals can be soldered to a circuit board (not shown). Because the present invention includes 8 terminals, it is rather difficult to assemble. According to the present invention, the terminals 18 is manufactured by an insert molding process and positioned within the isolation body 12 without assembling by manpower. That is, the terminals are positioned within a mold of the isolation body 12 beforehand, and melt material is poured into the mold of the isolation body 12. In this regard, when the isolation body 12 is formed, the terminals 18 are already fixed.

As shown in FIG. 3, the front metallic housing 14 of the male USB connector 10 is formed by bending metallic plate and is used to enclose the extension plate 122. A self-engagement portion 146 is formed at a bottom surface of the front metallic housing 14. As shown in FIG. 4, a top surface of the extension plate 122 abuts against the top plate of the front metallic housing 14, so that an insertion space 140 is formed between the bottom surface of the extension plate 122 and the front metallic housing 14. That is, an upper space of the front metallic housing 14 is used to receive the extension plate 122 so that the insertion space 140 is formed under the front metallic housing 14. In this regard, if the male USB connector 10 is reversed, than the male USB connector 10 cannot be plugged into the female USB connector 20. Therefore, the present invention provides an anti-disorientation function.

Reference is made to FIG. 3. The main body 121 of the isolation body 12 of the male USB connector 10 has engagement pieces 125 at its top surface and bottom surface (The engagement piece 125 at top surface is sheltered by the rear metallic housing 16 so the engagement piece 125 is not shown). A corresponding engagement plate 148 extends from the front metallic housing 14 and has an engagement hole 149 in order to engage with the engagement piece 125 of the main body 121.

Reference is made to FIGS. 1–3. The rear metallic housing 16 of the male USB connector 10 is formed by bending metallic plate and is substantially U-shaped. The male USB connector 10 includes a top plate 161 and a pair of side plates 162 are respectively used to enclose the top surface and two sides of the main body 121 of the isolation body 12. Reference is made to FIG. 2. A fixing plate 163 is formed at the top plate 161 of the male USB connector 10 by punching process and is used to push the main body 121 downwardly and abuts against the corresponding engagement plate 148 of the front metallic housing 14. Thus, the front metallic housing 14 is grounded via the rear metallic housing 16.

Reference is made to FIG. 1. A fixing plate 164 is formed at the side plates 162 of the rear metallic housing 16. Two guide grooves 123 are respectively positioned traverse at two sides of the main body 121 of the isolation body 12. The fixing plate 164 is used to push against the guide grooves 123. Thus, as shown in FIGS. 1 and 3, two engagement fringes 166 are respectively formed at the side plates 162 of the rear metallic housing 16 in order to engage with the main body 121 of the isolation body 12. The main body 121 is firmly positioned within the rear metallic housing 16. The main body 121 is not only fixed in the rear metallic housing 16 along a forth and back direction but also the main body 121 is fixed along a vertical direction within the rear metallic housing 16 by the fixing plate 164.

Two fixing extensions 168 are integrally formed with and extend from the side plate 162 of the rear metallic housing 16 so that the rear metallic housing 16 can be fixed at the circuit board.

Figure 6:
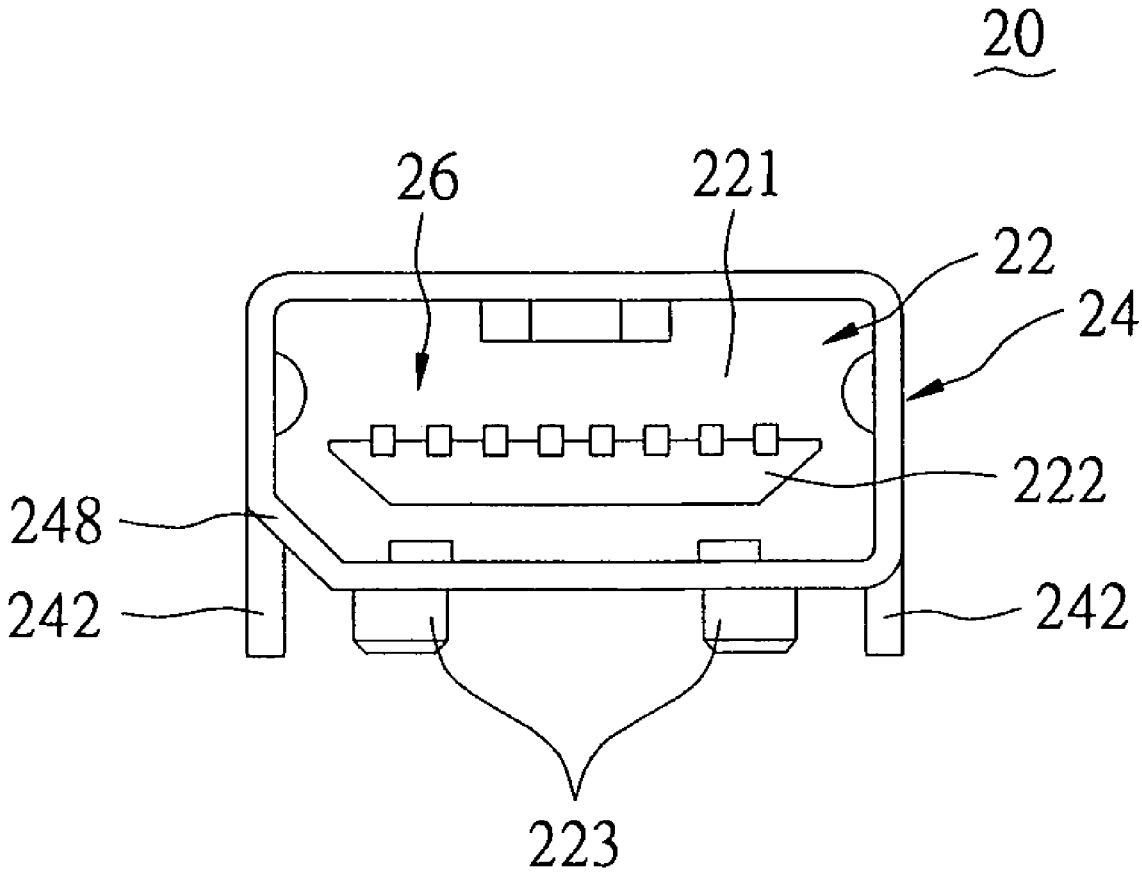
FIG. 6 is a front plan view of a female USB connector according to the present invention.

Reference is made to FIGS. 1–3 and 6. FIG. 6 illustrates a front plan view of the female USB connector 20 of the present invention. According to the present invention, the female USB connector 20 matches with the male USB connector 10 and includes a corresponding isolation housing 22, a corresponding metallic housing 24 and a plurality of terminals 26. The corresponding isolation body 22 includes a corresponding main body 221 and a corresponding extension plate 222 extending from the corresponding main body 221. A shape of the corresponding extension plate 222 corresponds with the insertion space 140 of the male USB connector 10, and the corresponding extension plate 222 is adapted to be received within the male USB connector 10.

The corresponding metallic housing 24 is formed by bending metallic plate and is used to enclose periphery of the corresponding isolation body 22. The terminals 26 are positioned at the corresponding extension plate 222 and penetrates through the corresponding main body 221 so that the terminals 26 can be soldered to the circuit board (not shown). According to the present invention, the terminals 26 are manufactured by the insert molding process and positioned within the corresponding isolation body 22.

Reference is made to FIG. 2. An opening 142 is positioned at the top surface of the front metallic housing 14 of the male USB connector 10. A resilient extension 249 is positioned the corresponding metallic housing 24 of the female USB connector 20 by punching process and corresponds with the opening 142 of the male USB connector 10. When the male USB connector 10 is plugged into the female USB connector 20, the opening 142 is used to receive the resilient extension 249 so that it prevents the male USB connector 10 and the female USB connector 20 being separated.

According to the present invention, the front metallic housing 14 of the male USB connector 10 has two bended areas 144 at its bottom (as shown in FIG. 4). A corresponding bended area 248 is formed at one side of the bottom surface of the corresponding metallic housing 24 of the female USB connector 20. (as shown in FIG. 6)

Reference is made to FIG. 1. The corresponding metallic housing 24 of the female USB connector 20 has two side plates which respectively have a front extension 242 and a rear extension 244 so that the female USB connector 20 can be fixed to the circuit board. The corresponding metallic housing 24 also has a pair of holding plates 246 to hold the sides of the corresponding main body 221 of the corresponding isolation body 22.

A pair of protrusions 223 are integrally formed with and extend from the corresponding main body 221 of the female USB connector 20 to aid the female USB connector 20 to be fixed at the circuit board.

As described above, advantages of the present invention are in the following.

1. According to the present invention, the male USB connector and the female USB connector of the mini-USB connector assembly respectively have 8 terminals so that transfer speed can be improved.

2. The terminals of the present invention are manufactured by the insert molding process so that the terminals are positioned within the isolation body and the corresponding isolation body without assembling by manpower.

3. According to the present invention, the main body 121 is firmly positioned within the rear metallic housing 16. The main body 121 is not only moved back and forth within the rear metallic housing 16 but the main body 121 is also moved along the vertical direction within the rear metallic housing 16 by the fixing plate 164.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A mini-Universal Serial Bus (USB) connector assembly, comprising:

a male USB connector, comprising:

an isolation body, including a main body and an extension plate extending from the main body, the main body of the isolation body having engagement pieces at a top surface and a bottom surface thereof;

a front metallic housing, used to enclose the extension plate and abutted against by a top surface of the extension plate, the front metallic housing having engagement plates extending therefrom, each engaging plate having an engagement hole in order to engage with a corresponding engagement piece of the main body, an insertion space being formed between a bottom surface of the extension plate and the front metallic housing;

an rear metallic housing, used to enclose the periphery of the main body; and a plurality of terminals, formed between a bottom surface of the extension plate and the front metallic housing and manufactured by an insert molding process, and positioned alongside on the bottom surface of the extension plates and penetrating through the main body so that the terminals can be soldered to a circuit board; and a female USB connector, comprising:

a corresponding isolation body, including a corresponding main body and a corresponding extension plate extending from the corresponding main body, a corresponding metallic housing, used to enclose the corresponding isolation body; and a shape of the corresponding extension plate corresponding to an insertion space of the male USB connector; and a plurality of corresponding terminals, manufactured by an insert molding process and penetrating through the corresponding main body so that the terminals can be soldered to a circuit board.

2. The mini-USB connector assembly as claimed in claim 1, wherein the rear metallic housing of the male USB connector is substantially U-shaped.

3. The mini-USB connector assembly as claimed in claim 2, wherein two guide grooves are respectively positioned traverse at two sides of the main body of the isolation body of the male USB connector, and the rear metallic housing has two fixing plates respectively formed on two side plates thereof to push against the guide grooves.

4. The mini-USB connector assembly as claimed in claim 3, wherein two engagement fringes are respectively formed at the side plates of the rear metallic housing in order to engage with the main body of the isolation body.

5. The mini-USB connector assembly as claimed in claim 3, wherein two fixing extensions are integrally formed with and extend from the side plate of the rear metallic housing.

6. The mini-USB connector assembly as claimed in claim 1, wherein a resilient extension is positioned the corresponding metallic housing of the female USB connector by punching process and corresponds with an opening of the male USB connector, and when the male USB connector is plugged into the female USB connector, the opening is used to receive the resilient extension.

7. The mini-USB connector assembly as claimed in claim 1, wherein the front metallic housing of the male USB connector has two bended areas at its bottom, and a corresponding area is positioned at one side of the bottom surface of the corresponding metallic housing of the female USB connector.

8. The mini-USB connector assembly as claimed in claim 1, wherein two fixing extensions are integrally formed with and extend from the side plate of the rear metallic housing for coupling the male USB connector to the circuit board.

9. The mini-USB connector assembly as claimed in claim 1, wherein a pair of protrusions are integrally formed with and extend from the corresponding main body of the female USB connector for coupling the female USB connector to the circuit board.

10. The mini-USB connector assembly as claimed in claim 1, wherein the male USB connector and the female USB connector respectively have 8 terminals.

* * * * *